US005980689A

United States Patent [19]

Germgård

[11] Patent Number: 5,980,689

[45] **Date of Patent: *Nov. 9, 1999**

[54] METHOD OF SEPARATING METAL IONS FROM PULP USING A CHELATING AGENT

[75] Inventor: Ulf Germgård, Sundsbruk, Sweden

[73] Assignee: Sunds Defibrator Industries AB, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,608

[22] PCT Filed: Oct. 6, 1994

[86] PCT No.: PCT/SE94/00930

§ 371 Date: Apr. 11, 1996

§ 102(e) Date: Apr. 11, 1996

[87] PCT Pub. No.: WO95/12710

PCT Pub. Date: May 11, 1995

[30] Foreign Application Priority Data

Nov. 5, 1993 [SE] Sweden ..... 9303644

[51] Int. Cl.[6] ..... D21C 9/153; D21C 9/16; D21C 11/00

[52] U.S. Cl. ..... 162/29; 162/40; 162/41; 162/65; 162/76; 162/78; 162/79

[58] Field of Search ..... 162/65, 76, 79, 162/78, 29, 43, 44, 45

[56] References Cited

U.S. PATENT DOCUMENTS

| | | | |
|---|---|---|---|
| 5,415,734 | 5/1995 | Backlund et al. | 162/78 |
| 5,462,641 | 10/1995 | Bergvist et al. | 162/541 |

FOREIGN PATENT DOCUMENTS

| | | |
|---|---|---|
| 0 564 433 A1 | 10/1993 | European Pat. Off. . |
| 94/01615 | 1/1994 | WIPO . |
| 94/05850 | 3/1994 | WIPO . |

*Primary Examiner*—Steven Alvo
*Attorney, Agent, or Firm*—Lerner, David, Littenberg, Krumholz & Mentlik, LLP

[57] ABSTRACT

Methods for separating metal ions from pulp material are disclosed including treating the pulp with a chelating agent to produce a pulp flow with dissolved metal ions, washing that pulp flow prior to bleaching with hydrogen peroxide or ozone and mixing the washed liquid containing metal ions with another flow of lignocellulose-containing material in order to bind the metal ions to that flow, washing that flow, and subsequently washing that flow at a reduced pH to produce a wash flow containing metal ions.

9 Claims, 2 Drawing Sheets

METHOD OF SEPARATING METAL IONS FROM PULP USING A CHELATING AGENT

FIELD OF THE INVENTION

The present invention relates to a method of separating metal ions from pulps of lignocellulose-containing material. More particularly, the present invention relates to such methods in connection with the bleaching of such pulps with hydrogen peroxide or ozone, in which methods a main flow of pulp is treated with a chelating agent and washed prior to such bleaching.

BACKGROUND OF THE INVENTION

In present pulp mills, as well as those contemplated in the future, there are and will be liquid flows which are contaminated by various metal ions, which can disturb the bleaching reactions which take place during bleaching with hydrogen peroxide or ozone. These liquid flows occur, for example, during totally chlorine-free bleaching, so-called TCF-bleaching (TCF=Totally Chlorine Free), when the pulp is treated with chelating agents, such as EDTA or DTPA, in order to substantially reduce the metal ion content of the pulp prior to its bleaching with peroxide or ozone. This type of bleaching, in order to yield high ISO-brightness, requires that both the pulp and the process water be free or substantially free of certain metal ions since otherwise the charged hydrogen peroxide will effectively disintegrate to water and oxygen gas, and the charged ozone to oxygen gas, without having any simultaneous bleaching effect.

Particularly at those times when the pulp mill is closed, for example for environmental reasons, these liquids containing metal ions can be very difficult to deal with in order to prevent their contact with the bleaching step which would then deteriorate bleaching efficiency.

SUMMARY OF THE INVENTION

These and other objects have now been realized by the invention of a method of separating metal ions from a metal-ion and lignocellulose-containing material comprising treating the metal-ion and lignocellulose-containing material with a chelating agent in order to produce a flow of lignocellulose-containing material containing dissolved metal ions, washing the flow of lignocellulose-containing material containing the dissolved metal ions to produce a first washed flow of lignocellulose-containing material and a first liquid stream containing the metal ions, bleaching the first washed flow of lignocellulose-containing material with a bleaching agent selected from the group consisting of hydrogen peroxide and ozone so as to produce a flow of bleached lignocellulose-containing material, mixing the first liquid stream containing the metal ions with a second flow of lignocellulose-containing material so as to bind the metal ions to the second flow of lignocellulose-containing material, washing the second flow of lignocellulose-containing material to produce a second washed flow of lignocellulose-containing material and a second liquid stream substantially free of the metal ions, and washing the second wash flow of lignocellulose-containing material at a pH of less than about 3 to produce a third washed flow of lignocellulose-containing material in a third liquid stream containing the metal ions.

In accordance with one embodiment of the method of the present invention, the method includes separating the flow of bleached lignocellulose-containing material into a primary flow of bleached lignocellulose-containing material and a secondary flow of bleached lignocellulose-containing material, and the second flow of lignocellulose-containing material comprises the secondary flow of bleached lignocellulose-containing material.

In a preferred embodiment of the method of the present invention, the method includes combining the third washed flow of lignocellulose-containing material with the primary flow of bleached lignocellulose-containing material.

In accordance with another embodiment of the method of the present invention, the second flow of lignocellulose-containing material comprises the flow of bleached lignocellulose-containing material.

In accordance with another embodiment of the method of the present invention, the second flow of lignocellulose-containing material comprises a separate flow of lignocellulose-containing material circulated separately from the flow of bleached lignocellulose-containing material.

In accordance with another embodiment of the method of the present invention, the method includes recycling the liquid stream as a washing liquid in the method.

The aforementioned problems are solved by the present invention in that both the pulp and the process water are purified of metal ions in connection with the bleaching of the pulp with hydrogen peroxide or ozone.

According to the present invention, undesired metal ions, in a concentrated state, are ejected from the bleach plant, and at the same time the bleached pulp is substantially free of metal ions. Furthermore, process water separated from the pulp can be used as washing water without disturbing the bleaching process. A liquid flow containing the undesired metal ions in a concentrated state is separated and can be treated separately, or it can be discharged without causing serious damage to the environment. The metal ion content can thus be as low as about 100 g of manganese per ton of pulp. This corresponds to the metal amount normally discharged from pulp mills producing TCF-pulp.

BRIEF DESCRIPTION OF THE DRAWINGS

The present invention can be more fully appreciated with reference to the following detailed description, which, in turn, refers to the Figures in which.

DETAILED DESCRIPTION

Figure 1:
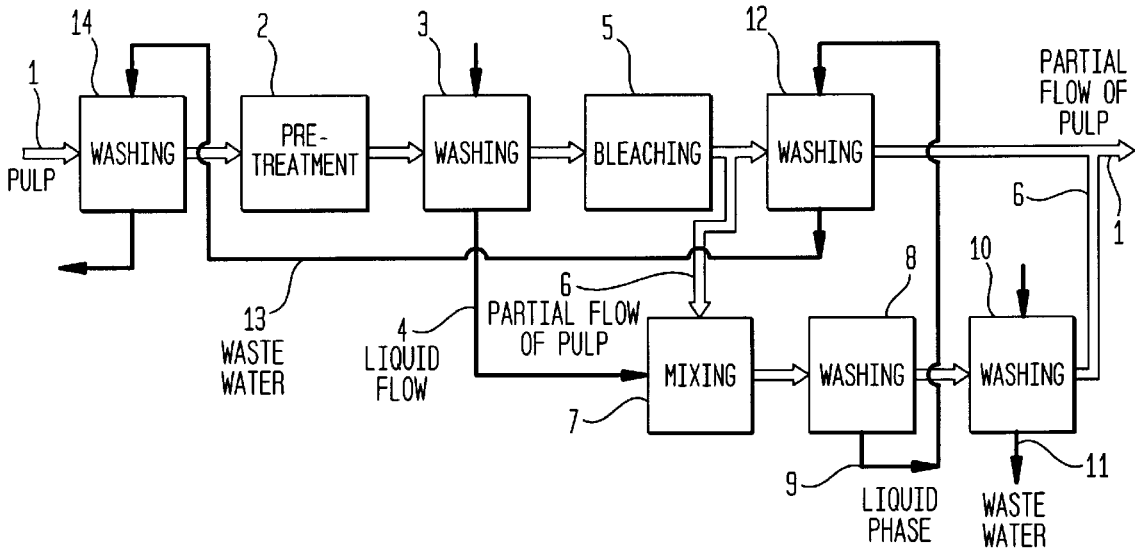
FIG. 1 is a schematic flow chart of a method according to the present invention.

Referring to the Figures, in which like reference numerals refer to like elements thereof, in the embodiment according to FIG. 1, a main flow 1 of unbleached pulp is supplied to a pre-treatment step 2 where the pulp is treated with a chelating agent such as EDTA or DTPA. Metal ions, preferably manganese, are thereby dissolved out of the pulp. In a subsequent first washing step 3, for example in the form of a washing press or washing filter, a liquid flow 4 is separated out containing the metal ions dissolved out of the pulp. The main flow 1, from which the metal ions are removed, is directed to a bleaching step 5 for bleaching with hydrogen peroxide or ozone. After the bleaching step, a partial flow 6 of the pulp is separated. This partial flow 6 constitutes a small portion, preferably from about 5 to 20%, and more preferably about 10% of the main flow 1.

To this partial flow 6 of the pulp, the liquid flow 4 containing metal ions is admixed, for example in a mixing device 7. By maintaining the pH above about 7, preferably above about 10, and most preferably at about 11 and 12, the metal ions are bonded to the pulp. Thereafter, the pulp in the partial flow 6 is washed in a second washing step 8, whereby the liquid phase 9 washed-out and free of the liquid can be re-used as washing water in the process. This liquid phase 9 will also contain the originally added chelating agent, because it is not bound by the pulp, but follows along with the liquid.

The partial flow 6 of the pulp, which now contains bound metal ions, is directed to a third washing step 10. Before washing, the pH is lowered to below about 3, and preferably to about 2.5, which can be brought about by the addition of sulfuric acid. The main part of the metal ions is hereby again released from the pulp and washed-out in the form of metal-containing waste water 11, which can be treated separately or be emitted to the recipient. This waste water corresponds to from about 1 to 2 $m^3$ per ton of pulp, based upon the total amount of the main flow of pulp. A special advantage from an environmental point of view is that the waste water 11 does not contain any chelating agent, because this material follows along with the liquid phase 9.

The main flow 1 of pulp is bleached with hydrogen peroxide or ozone in the bleaching step 5. After such bleaching, the pulp is washed in a washing step 12, whereafter the partial flow 6 of pulp free of metal ions is reunited with the main flow 1.

The liquid phase 9 free of metal ions can be used as washing liquid in the washing step 12. The waste water 13 from this washing step 12 can be recycled by being directed in a counter flow to the process, for example to a washing step 14 before the pre-treatment step 2.

EXAMPLE

The manganese content in a pulp delignified with oxygen gas was measured before and after the pre-treatment step 2, whereby the pH was varied by sulfuric acid addition during the treatment. The pulp concentration was 5%, the temperature 90° and the treatment time was 1 hour. The manganese content before the treatment was 61 g/ton of pulp. After the treatment, the following values were measured.

| | | | | |
|---|---|---|---|---|
| pH | 2.6 | 3.5 | 7.2 | 9.6 |
| $H_2SO_4$, kg/ton | 10 | 5 | 2 | 0 |
| Mn-content, g/ton | 4.4 | 20 | 45 | 48 |

It can thus be seen that the capability of the pulp to bind manganese ions varies with the pH value. According to the present invention, this relationship is being utilized to solve the problems encountered with metal ions in connection with peroxide and ozone bleaching.

Figure 2:
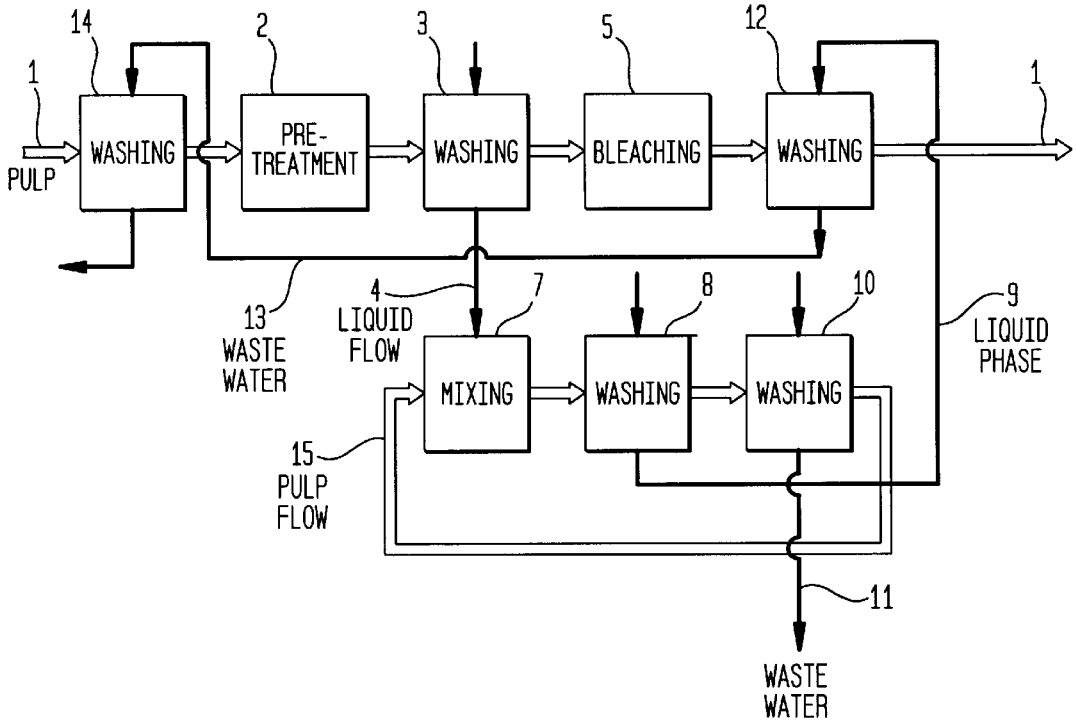
FIG. 2 is a schematic flow chart of another embodiment of the method of the present invention.

The embodiment according to FIG. 2 is similar to the embodiment shown in FIG. 1, with the exception that no partial flow is separated from the main flow 1 of pulp. Instead, a separate pulp flow 15 is used in this case. This pulp flow 15 is directed in a separate circulation with second and third washing steps 8 and 10, whereby the pulp takes up the metal ions out of the liquid flow 4 and then emits the metal ions into the waste water 11.

Figure 3:
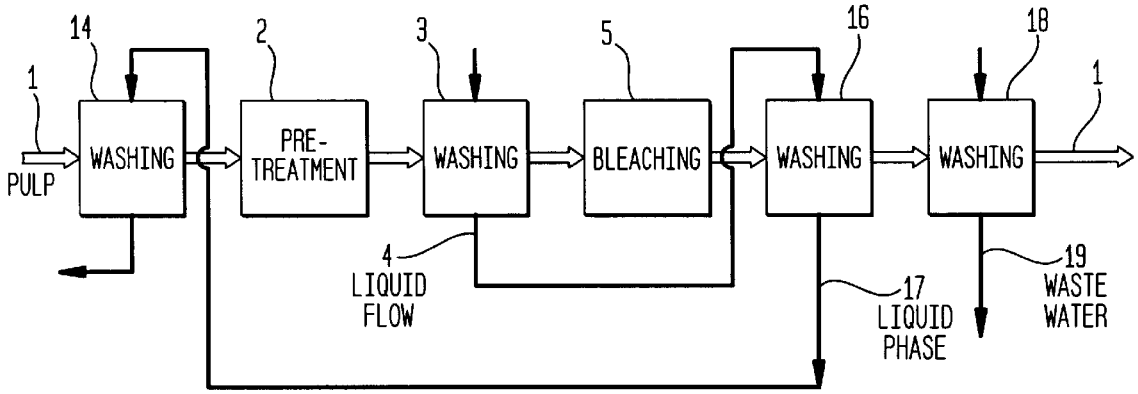
FIG. 3 is a schematic flow chart of another embodiment of the method of the present invention.

A further embodiment of the present invention is shown in FIG. 3. In this case, the main flow 1 of the pulp is used for separating metal ions. The liquid flow 4 separated in the washing step 3 after the pre-treatment step 2 is recycled to the main flow of pulp in the washing step 16 downstream of bleaching step 5. In this case, the metal ions are bonded to the pulp in the manner described above in connection with FIG. 1. The liquid phase 17 washed out and free of metal ions can thus be re-used as washing liquid in the process, for example by being returned to the washing step 14 upstream of the pre-treatment step 2.

The main flow 1 of pulp thereafter passes through a further washing step 18 where the metal ions are separated from the pulp in the manner described above in connection with FIG. 1. The waste water 19 thereby washed out can be treated separately or be emitted to the recipient.

According to the last-mentioned embodiment, only one extra washing step 18 is required, compared with a conventional plant. The metal ion concentration in the waste water 19, however, is lower than that according to embodiments 1 and 2.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method of separating metal ions from a metal-ion and lignocellulose-containing material comprising the steps of: treating said metal-ion and lignocellulose-containing material with a chelating agent in order to produce a first flow of lignocellulose-containing material containing metal ions; washing said flow of lignocellulose-containing material containing said metal ions and said chelating agent to produce a first washed flow of lignocellulose-containing material and a first liquid stream, said first liquid stream containing said metal ions and said chelating agent; bleaching said first washed flow of lignocellulose-containing material with a bleaching agent selected from the group consisting of hydrogen peroxide and ozone so as to produce a first flow of bleached lignocellulose-containing material; mixing said first liquid stream containing said metal ions and said chelating agent with bleached lignocellulose-containing material selected from the group consisting of (a discrete flow of bleached lignocellulose-containing, material) and a portion, but not all, of said first flow of bleached lignocellulose-containing material to produce a second flow of lignocellulose containing material so as to bind said metal ions to said bleached lignocellulose-containing material; washing said second flow of bleached lignocellulose-containing material to produce a second washed flow of bleached lignocellulose-containing material and a second liquid stream, said second liquid stream containing said chelating agent but being substantially free of said metal ions; and washing said second washed flow of lignocellulose-containing material at a pH of less than about 3 to produce a third washed flow of lignocellulose-containing material and a third liquid stream containing said metal ions.

2. The method of claim 1, wherein said second flow of lignocellulose-containing material is produced by mixing said first liquid stream containing said metal ions and said chelating agent with a discrete flow of bleached lignocellulose-containing material.

3. The method of claim 1, wherein said second flow of lignocellulose-containing material is produced by mixing said first liquid stream containing said metal ions and said chelating agent with a portion, but not all, of said first flow of bleached lignocellulose-containing material.

4. The method of claim 3, wherein said portion comprises from about 5 to about 20 percent of said first flow of bleached lignocellulose-containing material.

5. The method of claim 4, wherein said portion comprises about 10 percent of said first flow of bleached lignocellulose-containing material.

6. The method of claim 1, including combining said third washed flow of lignocellulose-containing material with said first flow of bleached lignocellulose-containing material.

7. The method of claim 1, including recycling said second liquid stream as a washing liquid in said method.

8. The method of claim 1, wherein said second liquid stream is a source of chelating agent for said method.

9. The method of claim 1, further comprising the step of maintaining the pH above about 7 so as to bind said metal ions to said bleached lignocellulose-containing material.

* * * * *